US007536954B2

(12) United States Patent
Yoo et al.

(10) Patent No.: US 7,536,954 B2
(45) Date of Patent: May 26, 2009

(54) PRINTING DEVICE SYSTEM AND PATTERNING METHOD USING THE SAME

(75) Inventors: Hong Suk Yoo, Gunpo-si (KR); Chul Ho Kim, Paju-si (KR); Jung Jae Lee, Gyeonggi-do (KR); Tae Young Oh, Anyang-si (KR)

(73) Assignee: LG. Display Co., Ltd., Seoul (KR)

( * ) Notice: Subject to any disclaimer, the term of this patent is extended or adjusted under 35 U.S.C. 154(b) by 207 days.

(21) Appl. No.: 11/479,017

(22) Filed: Jun. 29, 2006

(65) Prior Publication Data

US 2007/0119324 A1 May 31, 2007

(30) Foreign Application Priority Data

Nov. 28, 2005 (KR) ..... 10-2005-0114316

(51) Int. Cl.
*B41F 35/00* (2006.01)

(52) U.S. Cl. ..... 101/424.1; 101/487

(58) Field of Classification Search ..... 101/424, 101/424.1, 484, 485, 486, 487
See application file for complete search history.

(56) References Cited

U.S. PATENT DOCUMENTS 2,884,855 A 5/1959 Koch

FOREIGN PATENT DOCUMENTS

| | | |
|---|---|---|
| DE | 100 00 585 A1 | 8/2000 |
| EP | 1 232 306 | 10/2006 |
| GB | 722674 | 2/1953 |
| GB | 774950 | 6/1955 |
| GB | 854119 | 9/1958 |
| GB | 1141738 | 4/1967 |
| GB | 0009595 | 4/2004 |
| JP | 09-070946 | 3/1997 |
| JP | 2004-066804 | 3/2004 |
| JP | 2005-313365 | 11/2005 |

OTHER PUBLICATIONS

Office Action issued in corresponding Chinese Patent Application No. 200610094340.0; issued in Oct. 10, 2008.

Search Report dated Aug. 22, 2006 for corresponding Great Britain Patent Application No. 0612963.9.

Office Action for corresponding German Patent Application Serial No. 10 2006 029 497.1-27. dated Sep. 13, 2007.

Office Action issued in corresponding Taiwanese Application No. 095124067; issued Dec. 23, 2008.

*Primary Examiner*—Daniel J Colilla
*Assistant Examiner*—David Banh
(74) *Attorney, Agent, or Firm*—Brinks Hofer Gilson & Lione

(57) ABSTRACT

A printing device system comprises a printing roller that has a blanket adhered to an outer surface thereof. The printing device system further comprises a drying device that dries the blanket of the printing roller.

10 Claims, 6 Drawing Sheets

PRINTING DEVICE SYSTEM AND PATTERNING METHOD USING THE SAME

This application claims the benefit of the Korean Patent Application No. P2005-114316, filed on Nov. 28, 2005, which is hereby incorporated by reference.

FIELD

The present invention relates to a liquid crystal display (LCD) device, and more particularly, to a method for forming a pattern of an LCD device by printing.

BACKGROUND

Among various ultra-thin flat type display devices, which include a display screen having a thickness of several centimeters, a liquid crystal display (LCD) device can be widely used for notebook computers, monitors, aircraft, and etc. since it has advantages such as low power consumption and portability.

The LCD device includes lower and upper substrates facing each other at a predetermined interval therebetween, and a liquid crystal layer formed between the lower and upper substrates.

The lower substrate comprises a thin film transistor and a pixel electrode, and the upper substrate comprises a black matrix layer, a color filter layer and a common electrode.

The above LCD device includes various elements formed by repeated steps. Especially, a photolithography is used so as to form the elements in various shapes.

For the photolithography, it necessarily requires a mask of a predetermined pattern and a light-emission device, thereby increasing manufacturing cost. In addition, since the photolithography requires exposure and development, it causes a complicated process and an increasing manufacturing time.

To overcome these problems of the photolithography, a new patterning method has been developed, for example, a printing method. In the printing method, a predetermined material is coated on a printing roller, and then the printing roller is rotated on a substrate, to thereby form a predetermined pattern on the substrate.

Hereinafter, a related art printing method will be described with reference to the accompanying drawings.

FIGS. 1A to 1C are cross sectional views illustrating a printing method according to the related art.

As shown in FIG. 1A, first, a pattern material 20 is provided through a printing nozzle 10, and is coated on a printing roller 30. At this time, a blanket 35 is adhered onto an outer surface of the printing roller 30. That is, the pattern material 20 is coated onto the surface of the blanket 35.

The blanket 35 requires the good adherence to the printing roller 30, and requires the deformation resistance for the printing process. To this end, the blanket 35 is generally formed of Si-based resin.

Then, as shown in FIG. 1B, the printing roller 30 is rotated on a cliché plate 40 having concave 43 and convex 46 portions. That is, some pattern material 20*a* is transferred to the convex portions 46 of the cliché plate 40, and the remaining pattern material 20*b* is left on the surface of the printing roller 30, whereby a predetermined pattern 20*b* is formed on the blanket 35 of the printing roller 30 by the left pattern material 20*b*.

As shown in FIG. 1C, as the printing roller 30 is rotated on a substrate 50, the predetermined pattern 20*b* of the printing roller 30 is transferred to the substrate 50.

Unlike the photolithography, the printing method requires no exposure and development. Thus, the printing method has the simplified process and decreased manufacturing cost, whereby the printing method is appropriate to the mass production of LCD device.

However, as repeating the patterning process by printing, the blanket 35 of the printing roller 30 is deformed due to the pattern material 20. That is, a solvent of the pattern material 20 dissolves the blanket 35, whereby the blanket 35 is swollen. Accordingly, it is impossible to realize a precise pattern due to the deformation of blanket 35.

That is, as shown in FIG. 2A, when the printing roller 30 having the blanket 35 coated with the pattern material 20 is rotated on the cliché plate 40 including the concave and convex portions 43 and 46, if the blanket 35 is swollen, the pattern material 20 contacts with the concave portions. In this case, as shown in FIG. 2B, the pattern material 20*a* and 20*b* is transferred to the concave portions 43 as well as the convex portions 46. Accordingly, the pattern material 20*c* being left on the blanket 35 of the printing roller 30 is not in a desired pattern. As a result, it is impossible to realize the precise pattern since 'A' of FIG. 2B has no pattern material.

SUMMARY

A printing device system comprises a printing roller that has a blanket adhered to an outer surface thereof. The printing device system further comprises a drying device that dries the blanket of the printing roller.

In another aspect of the present invention, a printing device system comprises a rail. The printing device system further comprises a printing nozzle, a cliché plate, and a substrate sequentially positioned on the rail. The printing device system further includes a printing roller that has a blanket adhered to an outer surface thereof, and moves across the printing nozzle, the cliché plate, and the substrate along the rail. The printing device system then comprises a drying device, positioned over the rail, that dries the blanket of the printing roller.

In yet another aspect of the present invention, a patterning method comprises forming a predetermined pattern material on a printing roller that has a blanket adhered to an outer surface thereof, and rotating the pattern material on a substrate so as to transfer the pattern material on the substrate. The patterning method further comprises drying the blanket of the printing roller.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION

Reference will now be made in detail to the preferred embodiments of the present invention, examples of which are illustrated in the accompanying drawings. Wherever possible, the same reference numbers will be used throughout the drawings to refer to the same or like parts.

Hereinafter, a printing device system according to the present invention will be described as follows.

FIRST EMBODIMENT

Figure 1A:
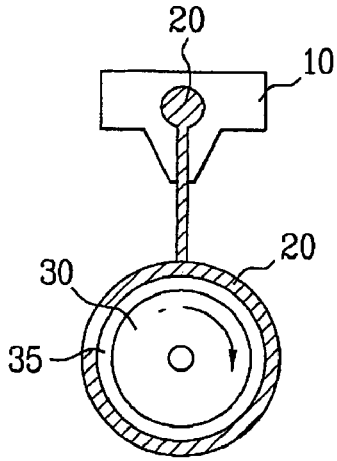
FIG. 1A Related Art
FIGS. 1A to 1C are cross sectional views illustrating a printing method according to the related art.
Figure 1B:
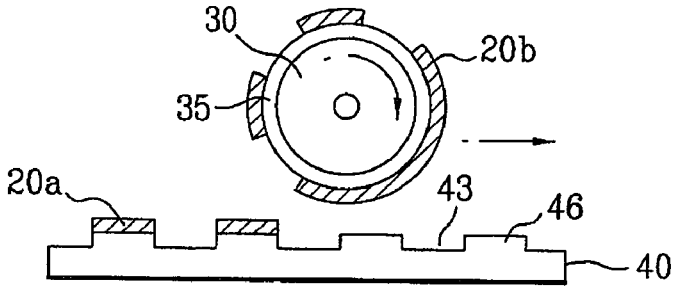
FIG. 1B Related Art
Figure 1C:
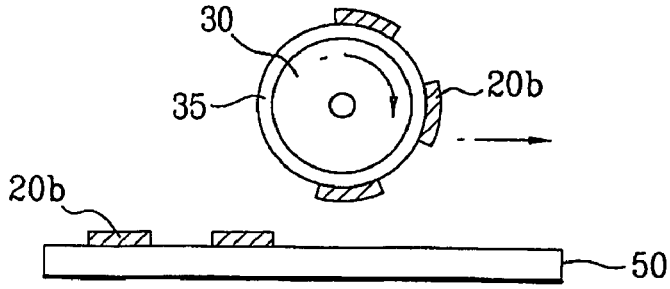
FIG. 1C Related Art
Figure 2A:
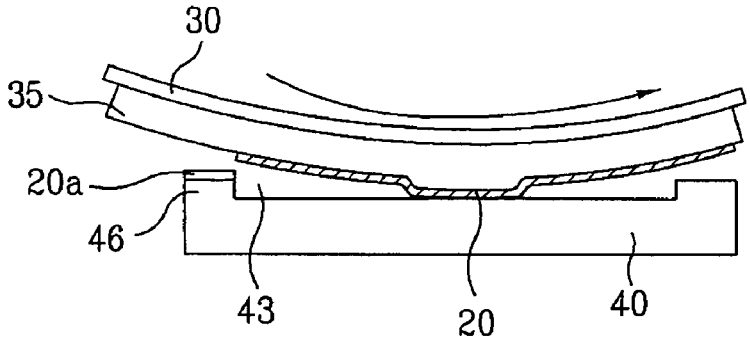
FIG. 2A Related Art
FIGS. 2A and 2B are cross sectional views explaining problems of a printing method according to the related art.
Figure 2B:
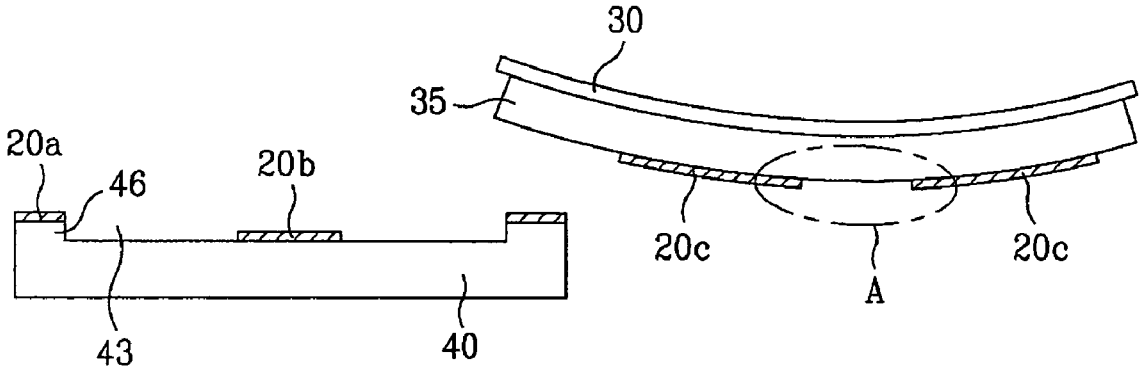
FIG. 2B Related Art
Figure 3:
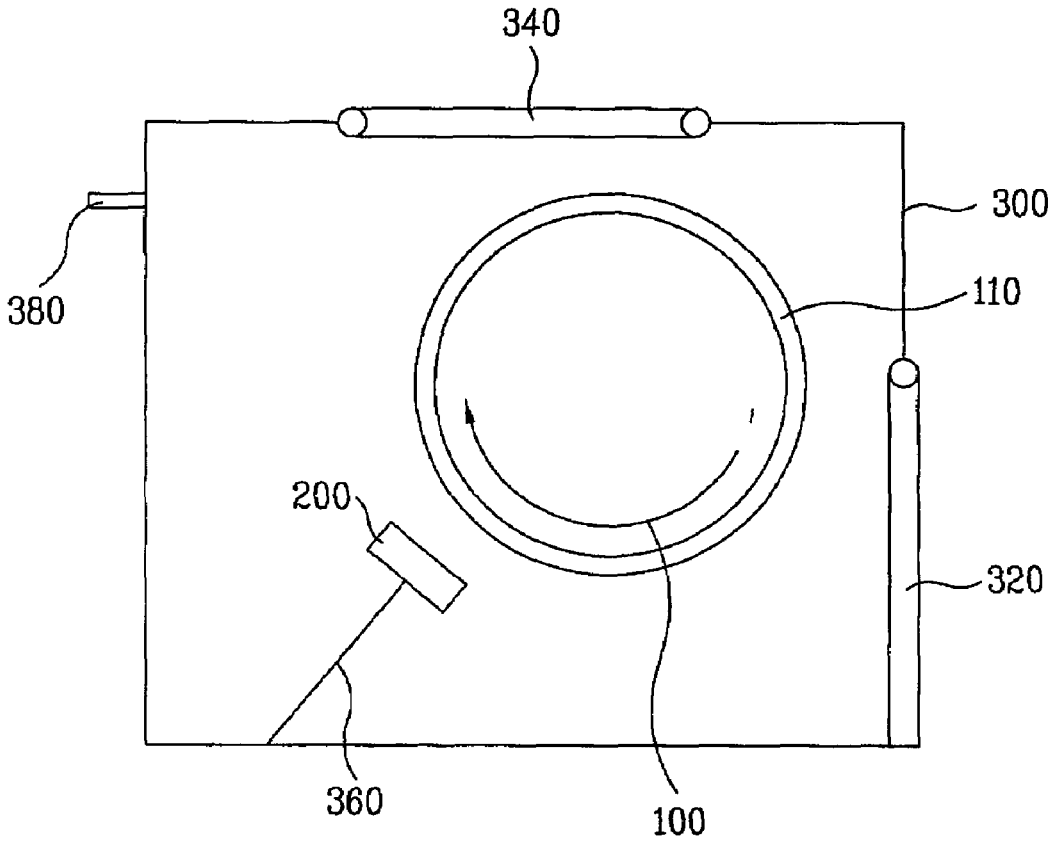
FIG. 3 is a schematic view of a printing device system according to the first embodiment of the present invention.
Figure 4A:
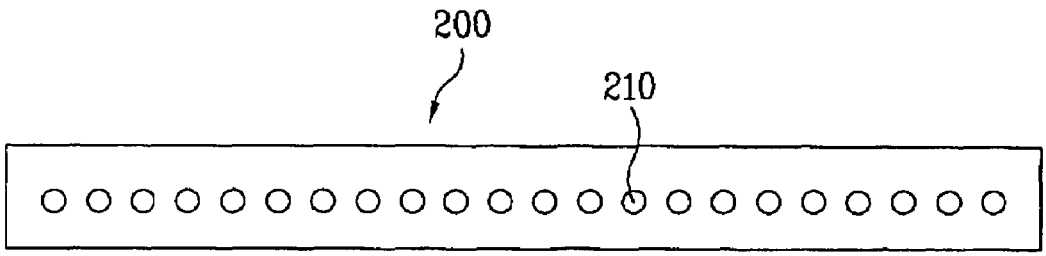
FIG. 4A is a bottom view illustrating a drying device according to one preferred embodiment of the present invention.
Figure 4B:
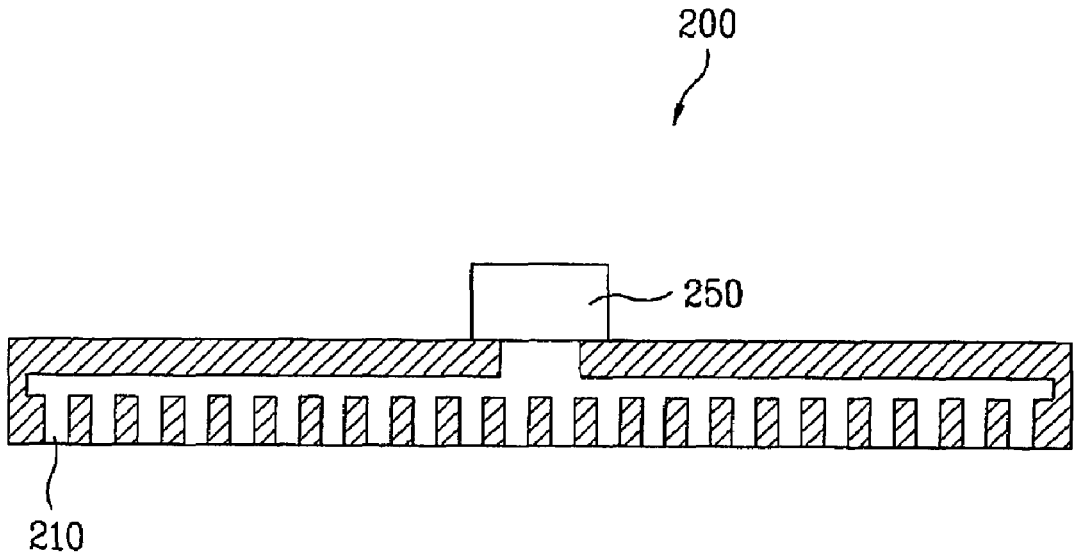
FIG. 4B is a cross sectional view illustrating a drying device according to one preferred embodiment of the present invention.
Figure 5A:
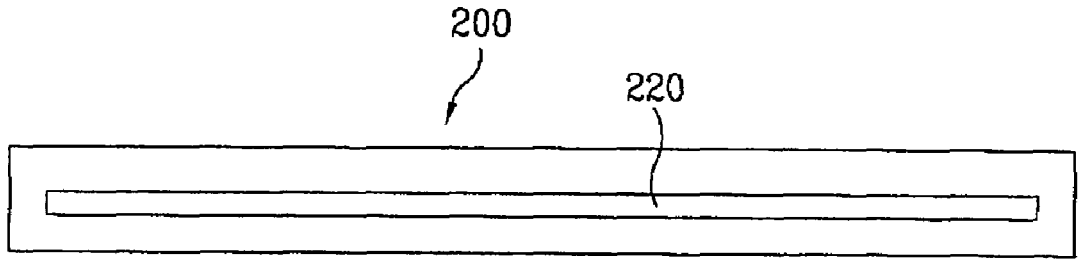
FIG. 5A is a bottom view illustrating a drying device according to another preferred embodiment of the present invention.
Figure 5B:
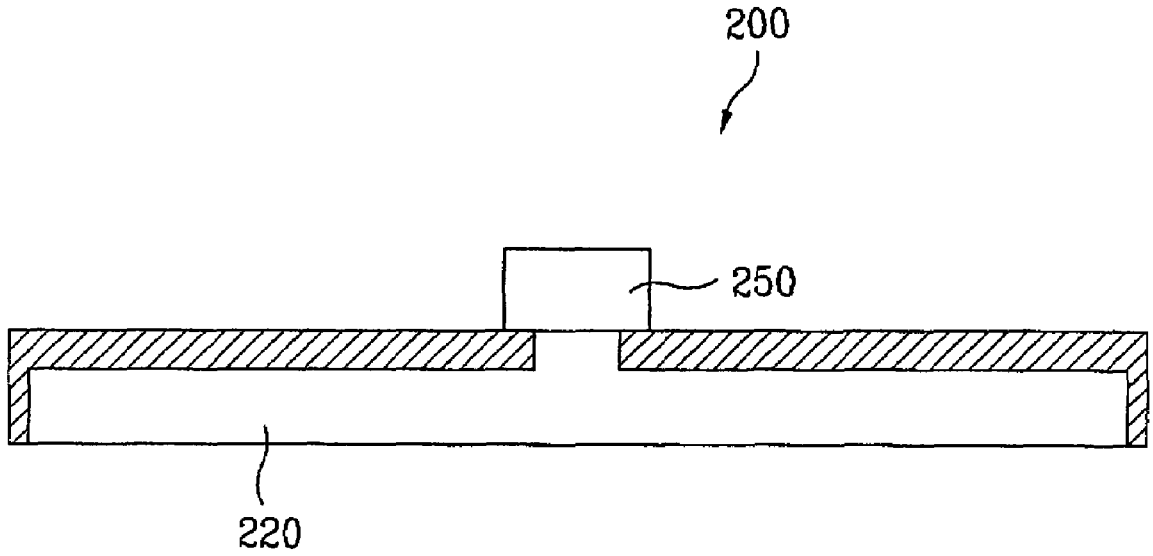
FIG. 5B is a cross sectional view illustrating a drying device according to another preferred embodiment of the present invention.

FIG. 3 is a schematic view of a printing device system according to the first embodiment of the present invention. FIG. 4A is a bottom view illustrating a drying device according to one preferred embodiment of the present invention, and FIG. 4B is a cross sectional view illustrating a drying device according to one preferred embodiment of the present invention. FIG. 5A is a bottom view illustrating a drying device according to another preferred embodiment of the present invention, and FIG. 5B is a cross sectional view illustrating a drying device according to another preferred embodiment of the present invention.

As shown in FIG. 3, a printing device system according to the first embodiment of the present invention is provided with a printing roller 100, a drying device 200, and a chamber 300 for accommodating the printing roller 100 and the drying device 200.

At this time, a blanket 110 is adhered to an outer surface of the printing roller 100. The drying device 200 dries the blanket 110 of the printing roller 100, wherein the drying device 200 is comprised of a vacuum suction part.

The vacuum suction part 200 will be explained with reference to FIGS. 4 and 5.

As shown in FIGS. 4A and 4B, the vacuum suction part 200 may include a plurality of holes 210, and a temperature controller 250. As shown in FIGS. 5A and 5B, the vacuum suction part 200 may include a slit 220 for sucking air, and a temperature controller 250. That is, the vacuum suction part 200 sucks the air through the plurality of holes 210 of FIG. 4 or through the slit 220 of FIG. 5, to thereby dry the blanket 110.

Also, the temperature controller 250 controls a temperature of the vacuum suction part 200, for the optimal drying state of the blanket 110.

Referring to FIG. 3, the printing roller 100 and the drying device 200 are contained in the chamber 300. As the printing roller 100 and the drying device 200 are tightly covered by the chamber 300, it is possible to dry the blanket 110 of the printing roller 100 under the state of minimizing the foreign materials.

In addition, a hydraulic device 360 is provided in the chamber 300. In this case, one end of the hydraulic device 360 is connected with the chamber 300, and the other end of the hydraulic device 360 is connected with the drying device 200. The hydraulic device 360 controls a gap between the drying device 200 and the printing roller 100.

The chamber 300 includes an inlet 320 for the printing roller 100. The chamber 300 includes an inlet 340 for a printing nozzle which supplies a pattern material to the printing roller 100.

Also, the chamber 300 is connected with a ventilator 380. When sucking the air by the vacuum suction part 200, an internal pressure of the chamber 300 is different from an external pressure of the chamber 300. In this case, if the printing roller 100 is moved to the outside of the chamber 300 through the inlet 320, the pressure difference may have negative effects on the pattern material coated on the printing roller 100.

To minimize these effects, preferably, the air is additionally supplied to the inside of the chamber 300 through the ventilator 380, thus the internal pressure of the chamber 300 is identical to the external pressure of the chamber 300.

SECOND EMBODIMENT

Figure 6:
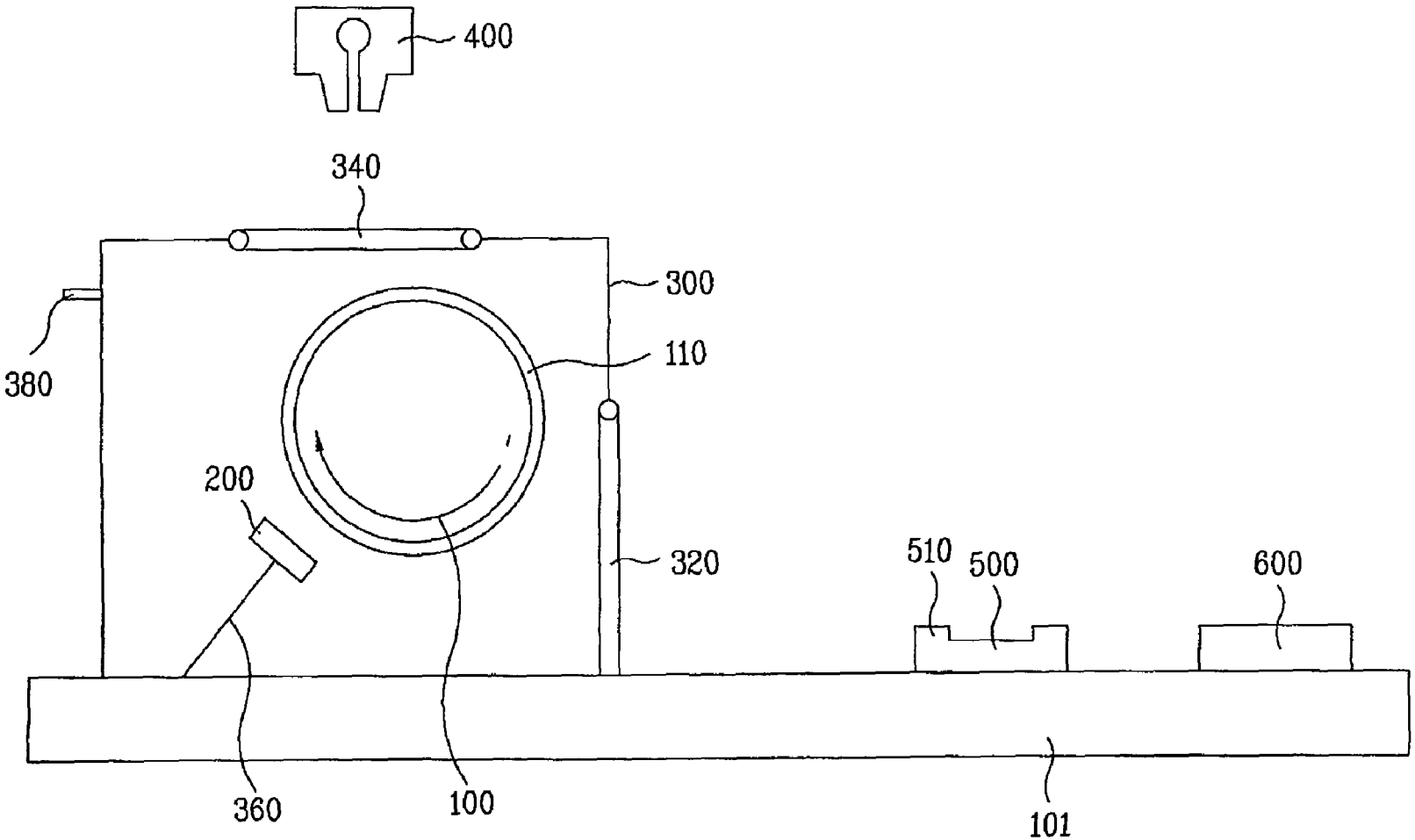
FIG. 6 is a schematic view illustrating a printing device system according to the second embodiment of the present invention.

FIG. 6 is a schematic view illustrating a printing device system according to the second embodiment of the present invention.

As shown in FIG. 6, a printing device system according to the second embodiment of the present invention is provided with a rail 101, a printing roller 100, a drying device 200, a chamber 300 for accommodating the printing roller 100 and the drying device 200, a printing nozzle 400, a cliché plate 500, and a substrate 600.

The printing roller 100, the drying device 200, and the chamber 300 of the second embodiment are identical in structure to those of the first embodiment.

That is, a blanket 110 is adhered to an outer surface of the printing roller 100.

Also, the drying device 200 may include a vacuum suction part comprised of a plurality of holes 210, and a temperature controller 250 as shown in FIG. 4, or may include a vacuum suction part comprised of a slit 220, and a temperature controller 250 as shown in FIG. 5.

The chamber 300 is comprised of a hydraulic device 360 for controlling a gap between the drying device 200 and the printing roller 100, an inlet 320 for the printing roller 100, and an inlet 340 for the printing nozzle 400.

Also, the chamber 300 is connected with a ventilator 380.

The printing roller 100 moves across the printing nozzle 400, the cliché plate 500, and the substrate 600 along the rail 101, so as to form a pattern on the substrate 600. That is, after a pattern material supplied from the printing nozzle 400 is coated on the printing roller 100, a predetermined pattern is formed on the printing roller 100 through the cliché plate 500. Then, the predetermined pattern of the printing roller 100 is transferred to the substrate 600.

Although not shown, a cleaning device for cleaning the cliché plate 500 is additionally provided in the rail 101.

The drying device 200, the printing nozzle 400, the cliché plate 500, and the substrate 600 are maintained in the fixed state, and the printing roller 101 is moved along the rail 101.

Hereinafter, a patterning method using the above printing device system according to the present invention will be described as follows.

The patterning method includes steps of forming a predetermined pattern on a printing roller having a blanket adhered thereto; transferring the predetermined pattern of the printing roller to a substrate by rotating the printing roller on the substrate; and drying the blanket of the printing roller. This patterning method can be performed with the above printing device system of FIG. 6, which will be explained with reference to FIG. 6.

First, the printing nozzle 400 moves to the inside of the chamber 300 through the inlet 340. Then, the pattern material is provided through the printing nozzle 400, and is coated onto the blanket 110 of the printing roller 100.

Thereafter, the printing roller 100 is moved to the outside of the chamber 300 through the inlet 320. Then, the printing roller 100 is moved to the cliché plate 500 along the rail 101. In this state, the pattern material is printed on the cliché plate 500.

The cliché plate 500 includes a predetermined projection 510. That is, the pattern material of the printing roller 100 is transferred to the projection 510 of the cliché plate 500. Then, the pattern material is left as a predetermined form on the printing roller 100.

After the printing roller 100 moves to the substrate 600 along the rail 101, the predetermined pattern material is transferred to the substrate 600.

Then, the printing roller 100 moves to the inside of the chamber 300 along the rail 101, and the blanket 110 of the printing roller 100 is dried by the drying device 200.

As shown in FIGS. 4 and 5, the drying device 200 includes the temperature controller 250 to control the temperature of the vacuum suction part. If drying the blanket 110 with the high-temperature air, the blanket 110 may be changed in elasticity and volume. To this end, it is preferable to use the room-temperature air.

To control the pressure, the air is supplied to the inside of the chamber 300 through the ventilator 380 connected with the chamber 300.

In the meantime, although not shown, a cleaning device for cleaning the cliché plate 500 may be additionally provided on the rail 101. After completing the patterning process, an additional process for cleaning the cliché plate 500 may be performed.

Preferably, the process for cleaning the cliché plate 500 and the process for drying the blanket 110 may be performed at the same time, so as to decrease the manufacturing time.

As mentioned above, the printing device system and patterning method using the same according to the present invention has the following advantages.

In the printing device system and patterning method using the same according to the present invention, the drying device is additionally provided to dry the blanket of the printing roller. Accordingly, it is possible to prevent the volume of blanket from being changed due to the dissolution of solvent included in the pattern material, thereby realizing a precise pattern.

Also, the printing roller and the drying device are positioned inside the chamber. Thus, the drying process is performed under the state of minimizing the environmental interference.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A patterning method comprising:

moving a printing nozzle to the inside of a chamber through a first inlet, and supplying a pattern material to a blanket adhered to a printing roller by the printing nozzle;

moving the printing roller to the outside of the chamber through a second inlet;

rotating the printing roller on a cliché plate that has a projection so as to transfer some pattern material onto the projection of the cliché plate, and so as to leave the remaining part of the pattern material as a predetermined form on the printing roller;

rotating the printing roller on a substrate, to transfer the predetermined form of the pattern material to the substrate;

moving the printing roller to the inside of the chamber, and drying the blanket of the printing roller;

wherein the process for drying the blanket is performed in the cylinder; and controlling a pressure inside the chamber after drying the blanket of the printing roller.

2. The method of claim 1, wherein the process of drying the blanket is performed by a vacuum suction part.

3. The method of claim 2, wherein the vacuum suction part is used in state of room-temperature air.

4. The method of claim 2, wherein the vacuum suction part includes a plurality of holes that sucks air.

5. The method of claim 2, wherein the vacuum suction part includes at least one slit that sucks air.

6. The method of claim 2, wherein the vacuum suction part includes a temperature controller.

7. The method of claim 1, wherein the process of controlling the pressure inside the chamber comprises supplying air to the inside of the chamber through a ventilator connected with the chamber.

8. The method of claim 1, further comprising controlling a gap between the printing roller and a drying device that dries the blanket by a hydraulic device, the hydraulic device having one end connected with the chamber and the other end connected with the drying device.

9. The method of claim 1, further comprising:

cleaning the cliché plate.

10. The method of claim 9, wherein the process of cleaning the cliché plate and the process of drying the blanket are performed at the same time.

* * * * *